US006033031A

United States Patent [19]

Campbell

[11] Patent Number: 6,033,031

[45] Date of Patent: Mar. 7, 2000

[54] MILLING MACHINE WITH VIBRATING MECHANISM AND ROTARY DRUM

[75] Inventor: Thomas Roger Campbell, Chattanooga, Tenn.

[73] Assignee: Astec Industries, Inc., Chattanooga, Tenn.

[21] Appl. No.: 09/040,203

[22] Filed: Mar. 13, 1998

[51] Int. Cl.[7] ..... E21C 25/06

[52] U.S. Cl. ..... 299/39.1; 299/37.2

[58] Field of Search ..... 299/14, 39.1, 39.2, 299/39.4, 39.6, 39.7, 37.1, 37.2; 404/90, 117, 114

[56] References Cited

U.S. PATENT DOCUMENTS

| | | | |
|---|---|---|---|
| 3,072,391 | 1/1963 | McDarrah | 299/37.3 |
| 3,504,598 | 4/1970 | Haker | 404/90 |
| 3,703,128 | 11/1972 | Fransson | 404/128 |
| 3,706,474 | 12/1972 | Neuenburg | 299/38.1 |
| 4,172,679 | 10/1979 | Wirtgen | 404/90 |
| 4,434,944 | 3/1984 | Bodine | 241/258 |
| 4,463,509 | 8/1984 | Leonard | 405/182 |
| 4,586,849 | 5/1986 | Hastings | 405/128 |
| 4,619,552 | 10/1986 | Sadahiro | 404/117 |
| 4,732,507 | 3/1988 | Artzberger | 404/117 |
| 4,775,262 | 10/1988 | Guntharp et al. | 404/183 |
| 4,993,869 | 2/1991 | Ulmer et al. | 404/117 |
| 5,046,891 | 9/1991 | Vural | 404/117 |
| 5,062,228 | 11/1991 | Artzberger | 37/407 |
| 5,078,540 | 1/1992 | Jakob et al. | 404/90 |
| 5,244,306 | 9/1993 | Artzberger | 404/128 |
| 5,505,598 | 4/1996 | Murray | 404/90 |

*Primary Examiner*—David Bagnell
*Assistant Examiner*—John Kreck
*Attorney, Agent, or Firm*—Chambliss, Bahner & Stophel, P.C.

[57] ABSTRACT

A milling machine is disclosed, which machine includes a frame, a drive mechanism for advancing the machine across a surface to be milled, and a milling assembly mounted on the frame of the machine for cutting a width of material from the surface in the path of the machine. The milling assembly includes a generally cylindrical milling drum having a plurality of cutting teeth, which drum is mounted for rotation about its axis. The milling assembly also includes a vibratory assembly which is mounted so as to impart vibration to the milling drum. The vibratory assembly includes an elongate shaft, a drive mechanism for rotating the shaft, and an eccentric weight that is mounted on the shaft. The eccentric weight has a non-symmetrical distribution of mass about the shaft so that vibration will be created upon rotation thereof. Also provided is a vibration isolator for isolating the vibratory assembly so as to limit the transmission of vibration created thereby to the frame of the machine.

15 Claims, 6 Drawing Sheets

MILLING MACHINE WITH VIBRATING MECHANISM AND ROTARY DRUM

FIELD OF THE INVENTION

The invention relates to milling or cold-planing machines for milling ready-mix concrete or asphalt concrete pavements. More specifically, the invention relates to the milling assembly for such machines.

BACKGROUND OF THE INVENTION

The durability and service performance of an asphalt roadway can be affected by a number of variables, including the asphalt mix composition that is used, the construction techniques employed in building the roadway, the overall weight and the axle weight of the vehicles using the roadway, the number and speed of the vehicles and the temperature and other environmental factors under which the roadway is used. Most of these various factors are beyond the control of the road designer. Furthermore, as traffic has increased on the nation's highways and as high-pressure radial tires have become more commonly used on heavy trucks, wear and even deterioration of the roadways has accelerated. Many of the nation's roads have suffered significant rutting damage, and are in need of repair.

Rutting is a manifestation of differential surface deformation in the wheel paths of a roadway which results from selective densification and shear deformation. Generally, the amount of pavement rutting depends, at least in part, on the traffic count and loads placed on the roadway and the distribution of such loads across the roadway. It will also be affected by the stresses introduced into the pavement system, and by the permanent strains induced as a result of these stresses. Rutting reduces road serviceability and driving comfort and will reduce the service life of a roadway. In addition, rutting may also contribute to safety hazards that may arise from an accumulation of water in the rutting paths. Such accumulation may lead to hydroplaning, or in appropriate weather conditions, icing.

One means of repairing a rutted roadway is to overlay the existing pavement with a new layer (often called a levelling course) of asphalt concrete. However, this method of repair generally results in the application of insufficient quantities of paving material in the rutted areas, because the overlayment will be applied at the same rate per unit of roadway width in the rutted areas (which have a higher surface area across the width) as in the undamaged areas. The resulting reduced density in the overlayment of the previously rutted areas will lead to renewed rutting in the new pavement in relatively short order. However, by milling or cold planing the surface of the damaged asphalt concrete pavement to a flat surface, the ruts will be eliminated and the new pavement will have a uniform density across the entire width of the roadway. In addition, a repaving technique that includes milling a thickness of old pavement and replacing it with an equivalent thickness of new pavement will return the elevation of the roadway to its initial level, whereas the placement of a levelling course atop damaged pavement will tend to raise the surface of the roadway or some portion thereof above its original elevation. This can require the raising of road shoulders, guardrails and manhole covers and the adjustment of overpass clearances, all of which is unnecessary if a proper milling technique is employed. A use of milling prior to repaving can also permit ready establishment of the proper road grade and slope, and thereby avoid drainage and safety problems. Furthermore, milling typically provides a rough surface that readily accepts and bonds with the new asphalt overlayment. Finally, milling can provide raw material that can be reclaimed for use in asphalt concrete production. Milling can also be utilized to remove the damaged upper surface of a ready-mix concrete roadway, preparatory to its being repaired or repaved with a layer of asphalt concrete.

Milling machines are typically wheeled or track-mounted vehicles that are provided with a rotating drum that includes a plurality of cutting teeth. The drum is mounted on the frame of the machine and adapted to be lowered into contact with the road surface and rotated about a fixed horizontal axis so as to cut into the surface to a desired depth as the machine is advanced along the roadway. Power for rotation of the drum is usually provided by the drive engine for the machine. Generally, the machine also includes a conveyor system that is designed to carry the milled material that has been cut from the roadway by the rotating drum to a location in front of the machine for deposit into a truck for removal from the site. Such machines are designed to cut into the pavement surface to a depth of eight inches (20.32 cm) or more, and for a width of up to 13 feet (3.96 m). Consequently, they are necessarily quite massive and powerful machines. It is not uncommon for a milling machine that is adapted to mill a full-lane width (13 feet) of a roadway to require an engine having up to 1200 hp (895 kW) of power. In addition, the conventional milling process puts considerable physical stress on the cutting teeth and their mounting means on the drum. Cutting tooth wear and breakage is a serious problem in the operation of conventional milling machines. Such machines are therefore somewhat expensive to operate and maintain, and consequently, various methods and devices have been developed to improve efficiencies of operation of the milling machine.

Most such improvements have related to the arrangement and configuration of the cutting teeth on the milling drum. U.S. Pat. No. 5,078,540 of Jakob et al. and U.S. Pat. No. 5,505,598 of Murray describe examples of such improved milling drum assemblies.

Other improvements have related to the means by which the machine cuts the pavement or other operative features of the machine. One such improved means of operation is described in U.S. Pat. No. 3,072,391 of McDarrah. This patent describes a milling machine which includes a small cutter drum having a plurality of cutter elements supported thereon at one end so as to be capable of swinging freely about a plurality of shafts that are parallel to the axis of rotation of the drum. As the drum rotates, the centrifugal force on each cutter element is such that each element extends substantially radially of the axis of rotation of the drum to provide both a cutting and impact action on the roadway. However, the cutting elements of the McDarrah machine are not as efficient or as easily replaceable as are the cutting teeth of the conventional milling machine.

It would be desirable if an improved milling machine could be developed that would increase the efficiency of operation of the machine without substantially increasing its weight, capital cost or operating cost. It would also be desirable if such an improved machine could be developed that would employ the type of cutting teeth that are commonly in use in modern milling machines. It would also be desirable if such a machine could be developed that would permit mounting of such teeth or cutting tools in the manner commonly in use.

OBJECTS AND ADVANTAGES OF THE INVENTION

Accordingly, it is an object of the invention claimed herein to provide an improved milling machine that is more efficient to operate than a conventional machine. It is another object of this invention to provide such a machine that is more economical to purchase and operate than a conventional machine. It is still another object of this invention to provide such a machine that requires less mass and power than a conventional machine capable of performing the same amount of work. Another object of this invention is to provide such a machine that employs conventional cutting teeth which are mounted on the milling drum in a conventional fashion. A further object of this invention is to provide a method and apparatus for increasing the ability of the cutting teeth on a milling drum to penetrate and cut into the surface layer of an asphalt concrete or ready-mix concrete roadway.

Additional objects and advantages of this invention will become apparent from an examination of the drawings and the ensuing description.

SUMMARY OF THE INVENTION

Accordingly, a portable milling machine is disclosed, which machine includes a frame and means for advancing the machine across a surface to be milled. The machine also includes a milling assembly mounted on the frame for cutting a width of material from the surface in the path of the machine. The milling assembly includes a generally cylindrical milling drum which is mounted for rotation about its axis, which drum is provided with a plurality of cutting teeth. A vibratory assembly is also provided, which is mounted so as to impart vibration to the milling drum. The vibratory assembly includes an elongate shaft, means for rotating the shaft, and an eccentric weight that is mounted on the shaft, which weight has a non-symmetrical distribution of mass about the shaft so that vibration will be created upon rotation thereof. Also provided is means for isolating the vibratory assembly so as to limit the transmission of vibration created thereby to the frame of the machine.

In order to facilitate an understanding of the invention, the preferred embodiments of the invention are illustrated in the drawings, and a detailed description thereof follows. It is not intended, however, that the invention be limited to the particular embodiments described or to use in connection with the apparatus illustrated herein. Various modifications and alternative embodiments such as would ordinarily occur to one skilled in the art to which the invention relates are also contemplated and included within the scope of the invention described herein.

BRIEF DESCRIPTION OF THE DRAWINGS

Preferred embodiments of the invention are illustrated in the accompanying drawings, in which like reference numerals represent like parts throughout, and in which.

DESCRIPTION OF THE PREFERRED EMBODIMENTS

Figure 1:
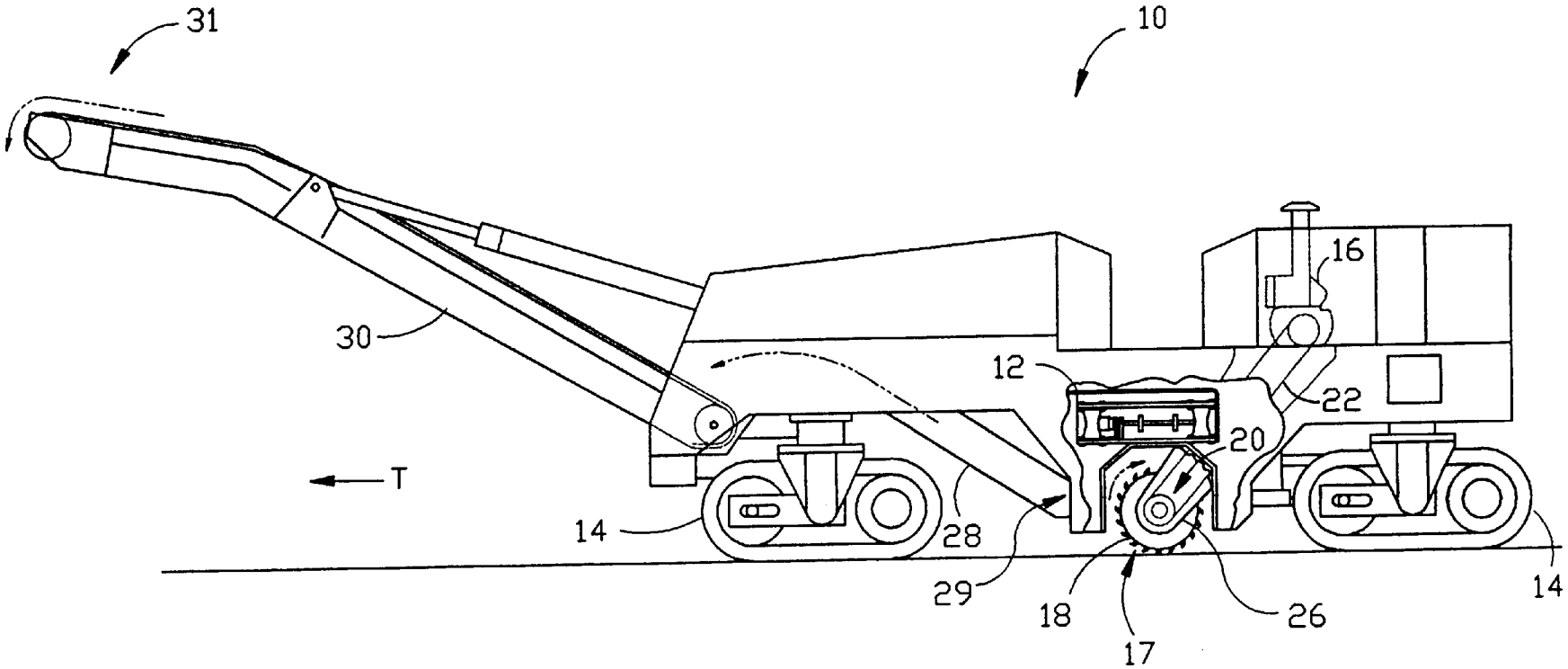
FIG. 1 is a side elevation view, partly in section, of a milling machine which incorporates a preferred embodiment of the invention.
Figure 2:
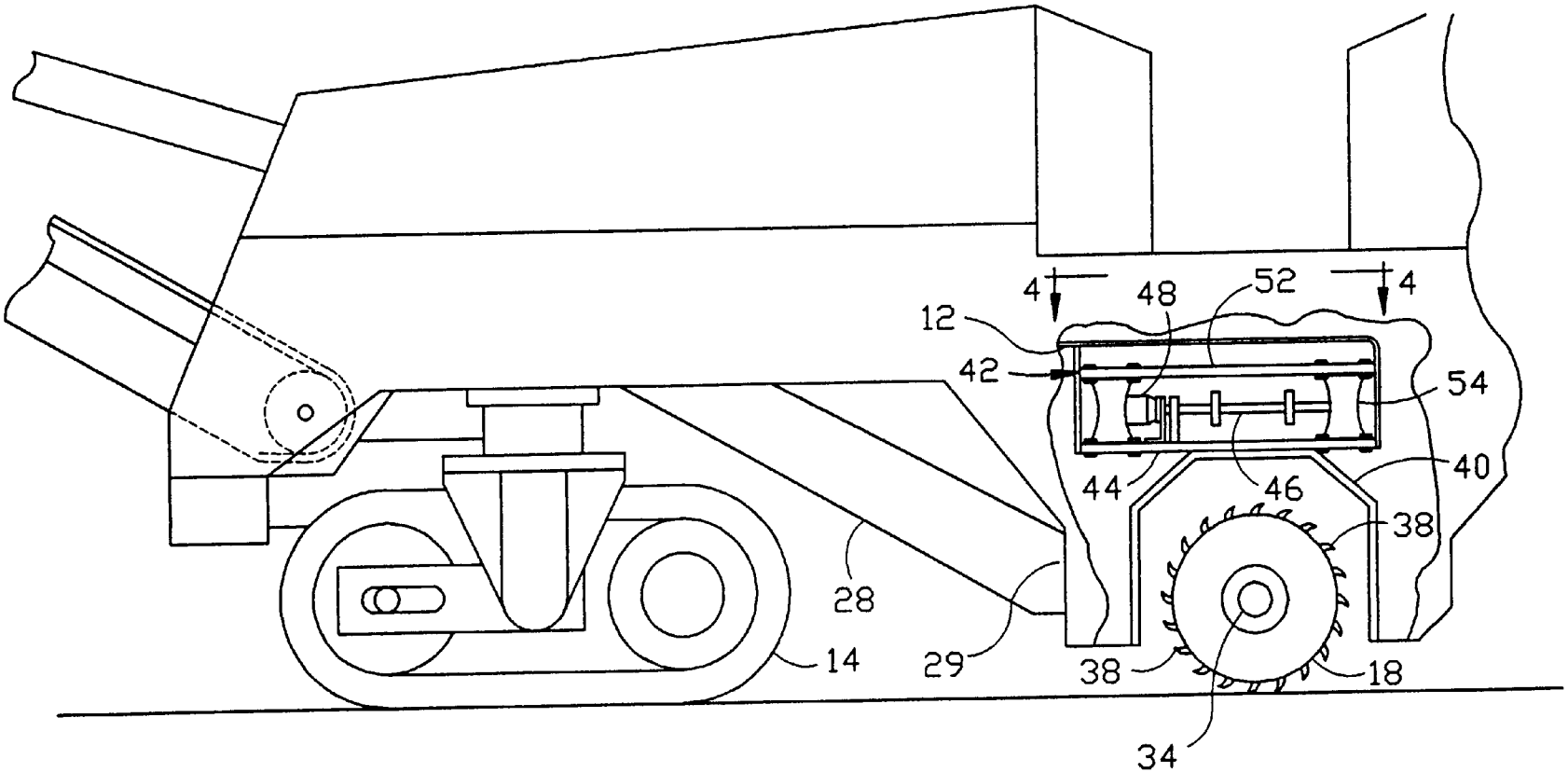
FIG. 2 is an enlarged view of a portion of the milling machine of FIG. 1, with part of the drive system for the milling drum deleted.

Referring now to the drawings, a milling machine embodying the features of a preferred embodiment of the present invention is indicated generally at 10. This machine comprises a portable or mobile vehicle having a frame, a portion of which is shown at 12, and three ground-engaging tracks 14 (two of which are shown in FIG. 1). As is conventional, the three or four tracks may all be steerable to provide precise directional control, and they are typically driven by hydraulic motors (not shown), which in turn are powered by engine 16, to advance the machine across the surface of a roadway, parking lot or other surface to be milled. The machine includes a milling assembly 17, which includes a generally cylindrical milling drum 18, and which is adapted for cutting a width of material from the surface in the path of the machine. The milling assembly is mounted to frame 12 in a conventional way at a medial location along its length. The drum of the assembly is mounted for rotation about its axis, a horizontal axis that is generally disposed transverse to the direction of travel "T" of the machine.

Figure 6:
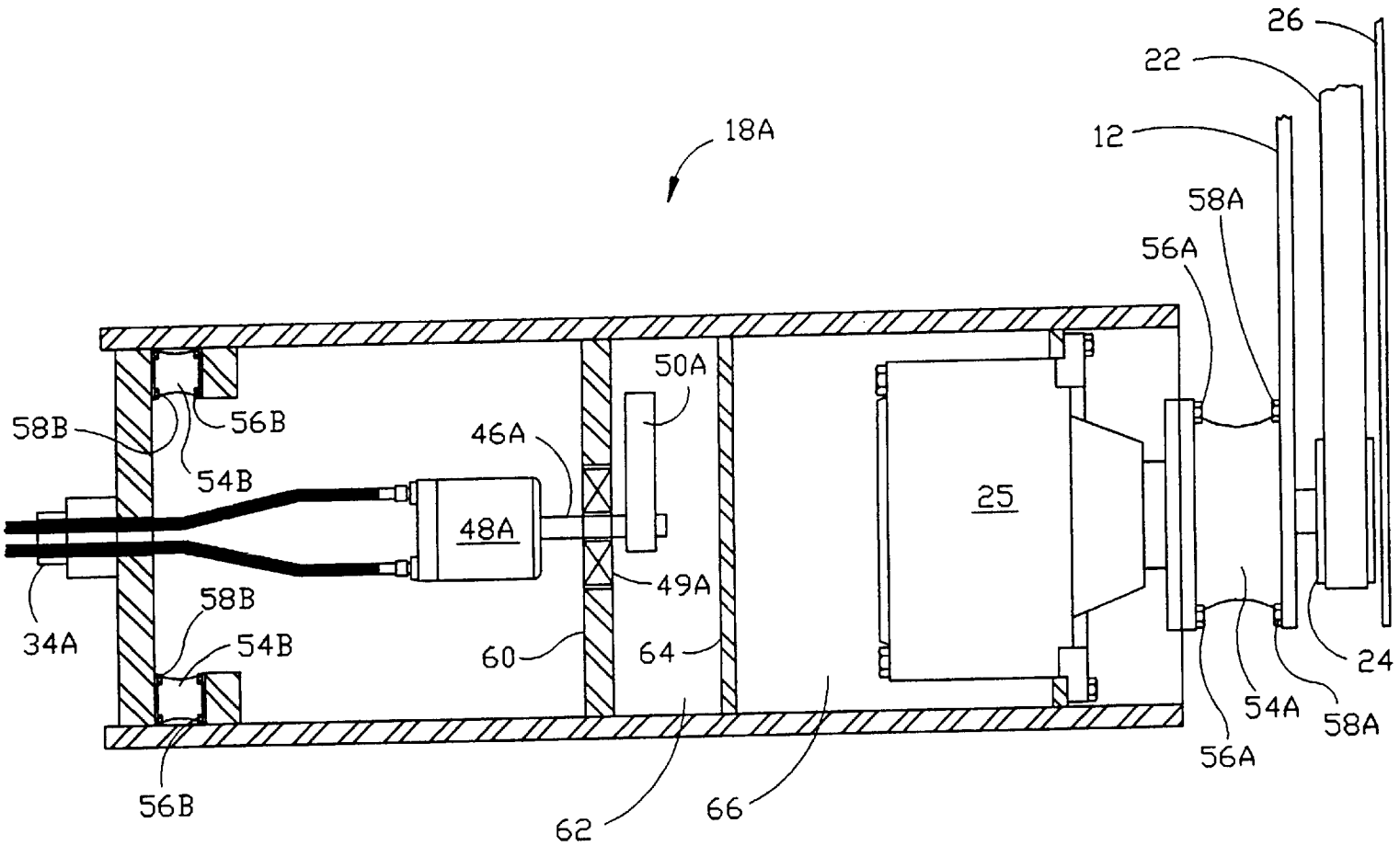
FIG. 6 is a sectional view of a milling drum that is identical in external configuration to the drum of FIG. 5 with the cutting teeth and mounting means deleted for simplicity, and that illustrates an alternative embodiment of the invention.

Drum 18 is rotatably driven by engine 16 in a clockwise direction (as indicated by the directional arrow) by means of pulley drive system 20 or by other convenient means, although it may alternatively be driven in a counterclockwise direction. System 20, a portion of which is best illustrated in FIG. 6 in connection with an alternative embodiment of the invention, includes an on-off clutch (not shown), drive belt 22, belt coupling 24 and final drive gear box 25, which is mounted, as is conventional, inside the drum. Drive arm 26 covers a portion of the drum and some of the components of drive system 20, as shown in FIG. 1.

Machine 10 is designed to convey the milled roadway material in the forward direction for deposit in a truck (not shown). For this purpose, the machine includes a two-part conveyor system. This conveyor system includes lower conveyor 28, which has an inlet end 29 located immediately in front of the drum, and upper conveyor 30, which has an elevated outlet end 31 located in front of the frame of the machine. This arrangement permits rotation of the drum in the indicated direction to lift the milled material into the inlet end of the conveyor system, which in turn conveys the material to the outlet end (as shown by the directional arrows), where it may be deposited into a truck.

Figure 5:
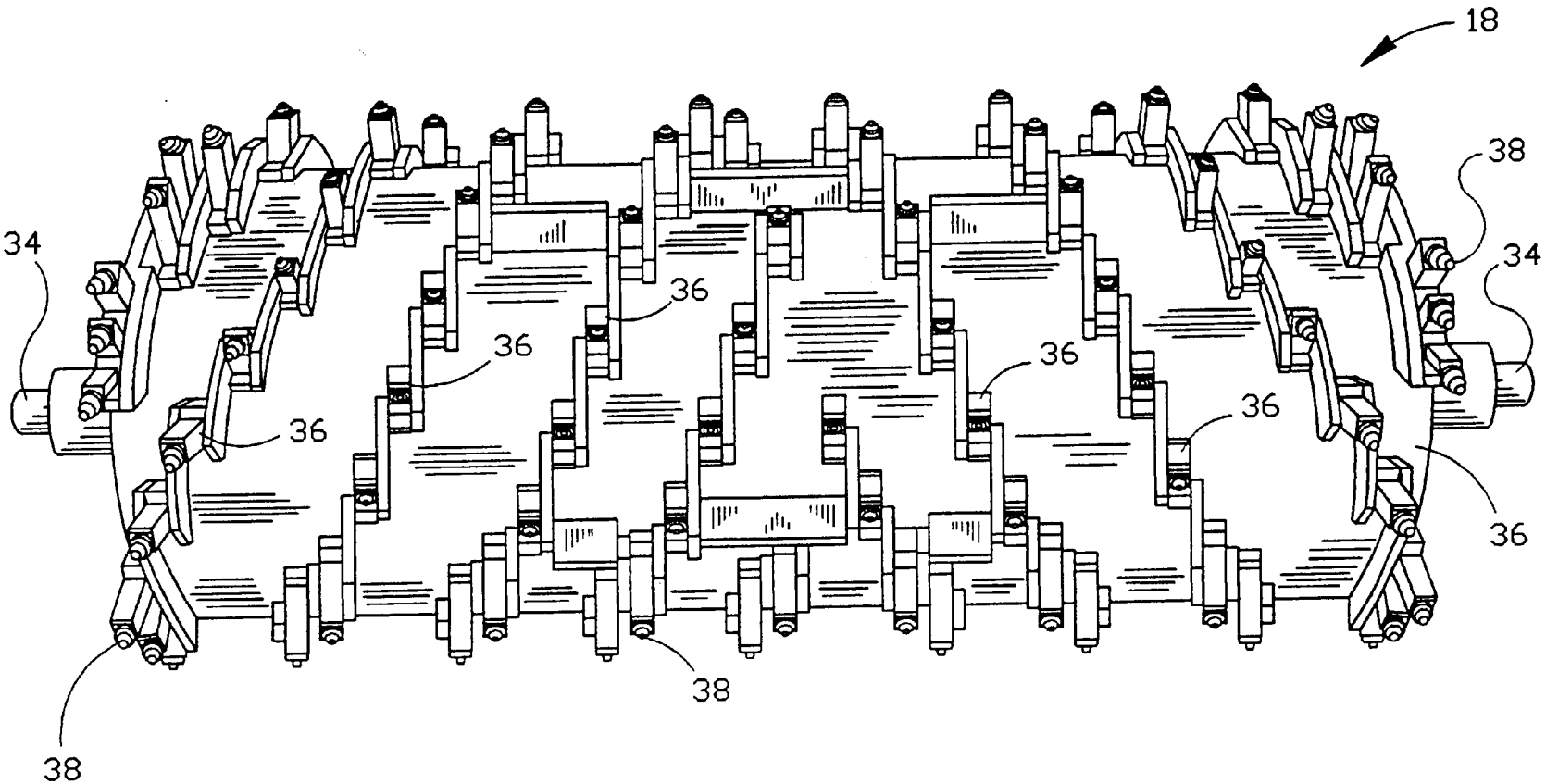
FIG. 5 is a front view of the milling drum of the embodiment of the invention that is illustrated in FIGS. 1 through 4.

As best shown in FIG. 5, milling drum 18 includes a cylindrical outer surface 32 which is arranged coaxially with end mounting shafts 34. A plurality of tooth-mounting assemblies 36 are fixed to the surface of the drum, as by welding, and in this particular embodiment of the invention, the assemblies are arranged to define oppositely directed helices. The drum includes a plurality of cutter teeth 38 that are attached to the mounting assemblies in a conventional manner. Generally, conventional milling drums are equipped with 100–200 cutting teeth having tungsten carbide tips, and are designed to be rotated at average speeds of 75–120 rpm to optimize productivity and minimize tooth wear.

In a typical milling or cold planing machine, the engine runs at a speed of 2000–2500 rpm. Most of the engine's power, on the order of 70–80%, is used to drive the milling drum, with the remaining power being required to move the machine or power its auxiliary systems, such as conveyors 28 and 30. In order to transmit power from the engine to the milling drum, and to reduce the rotational speed of the engine from 2000–2500 rpm to the desired rotational speed of the drum, gear box 25 is employed. This gear box is preferably a planetary gear box, which operates at a total efficiency of about 90%. If a milling machine provides 300 hp (224 kW), for example, to drive the milling drum, approximately 30 hp (22 kW) will be lost in the gear box, primarily as heat. Consequently, the gear box is generally immersed in a coolant, which permits transfer of heat from the outer surface of the gear box to the wall of the milling drum, for transfer therethrough to the atmosphere.

Figure 3:
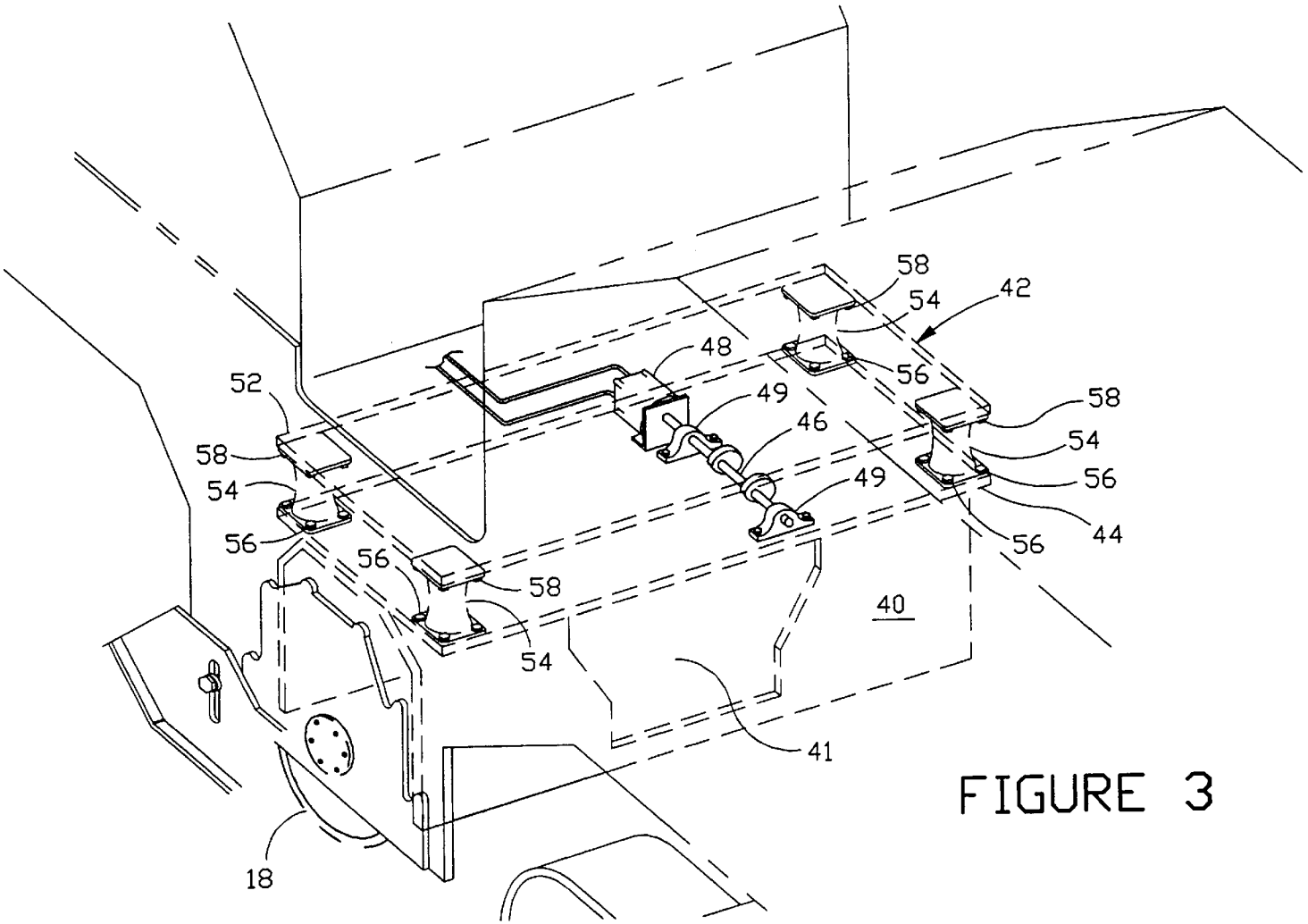
FIG. 3 is a perspective view of a portion of the preferred embodiment of the invention that is illustrated in FIG. 2.
Figure 4:
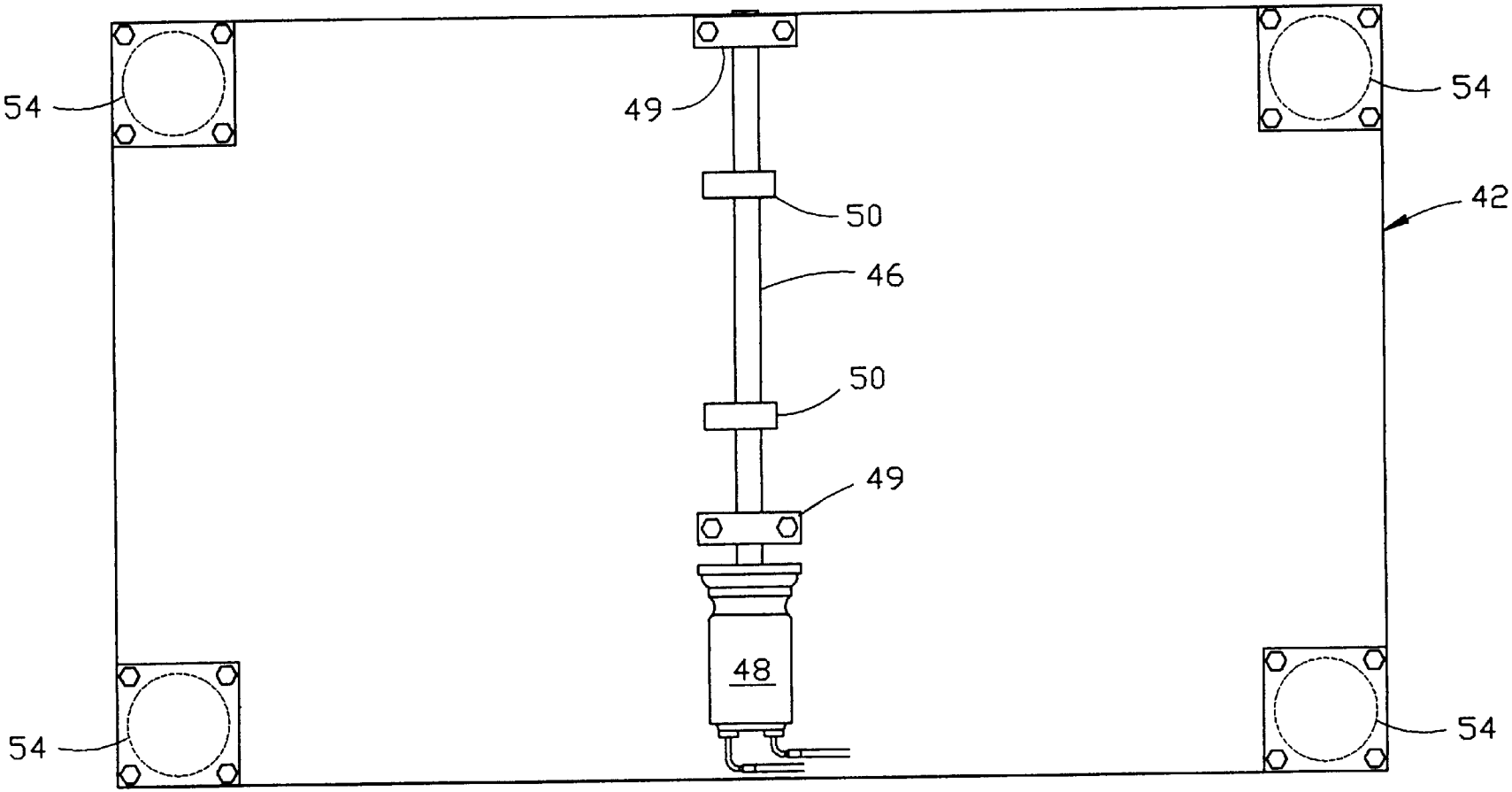
FIG. 4 is a top view of a portion of the vibratory assembly of the preferred embodiment of the invention that is illustrated in FIGS. 1 through 3, taken along the lines 4—4 of FIG. 2, but excluding the isolator plate.

Referring now to FIGS. 1 through 5, which illustrate a preferred embodiment of the invention, milling machine 10 includes cutter enclosure 40, in which drum 18 is mounted. As shown in FIG. 3, enclosure 40 is provided with opening 41 to accommodate inlet end 29 of lower conveyor 28.

The milling machine also includes vibratory assembly 42, which is mounted so as to impart vibration to the milling drum. Preferably, assembly 42 is mounted atop vibrator plate 44 by any convenient means, and plate 44 is rigidly mounted on top of enclosure 40, preferably by welding. The vibratory assembly includes an elongate shaft 46, and means for rotating the shaft, such as hydraulic motor 48. Preferably, the shaft is supported by and journaled in at least one bearing assembly, such as assembly 49. Assembly 42 also includes an eccentric weight, such as weight 50, that is mounted on the shaft. Preferably, at least a pair of said weights are provided, as shown in the drawings. Weights 50 are mounted so as to have a non-symmetrical distribution of mass about shaft 46 so that vibration will be created upon rotation thereof.

The milling assembly also includes means for isolating the vibratory assembly so as to limit the transmission of vibration created thereby to the frame of the machine. Preferably, isolator plate 52 is rigidly mounted to frame 12 by any convenient means, and at least one elastomeric pad, such as pad 54, is positioned between the vibratory assembly and the isolator plate so as to limit the transmission of vibration created by the vibratory assembly to the frame. In the preferred embodiment of FIGS. 1 through 4, four elastomeric isolator pads 54 are positioned between vibratory assembly 42 and isolator plate 52 of the machine, although any convenient number of pads may be used. Preferably, these pads are made of natural or synthetic rubber or other suitable elastomeric material, and are attached to vibrator plate 44 by means of bolts 56, and to isolator plate 52 by means of bolts 58.

An alternative embodiment of the invention is illustrated in FIG. 6, which shows a sectional view of milling drum 18A, which is identical in external configuration to drum 18, although such is not shown in the drawings. The vibratory assembly of this alternative embodiment of the invention is located within drum 18A. In the embodiment illustrated in FIG. 6, hydraulic motor 48A is mounted to bulkhead 60 by any convenient means (not shown). Motor 48A turns shaft 46A, which is supported by and journaled in bearing 49A. Preferably shaft 46A is aligned with the axis of the milling drum. Weight 50A is mounted, in an eccentric fashion, to shaft 46A so that the weight may rotate in an airspace 62 enclosed by bulkheads 60 and 64. This latter bulkhead isolates the vibration assembly from fluid chamber 66, in which is provided the coolant for gear box 25. Vibration from the vibratory assembly is isolated from the frame 12 of the milling machine by elastomeric isolator pads 54A and 54B. Pads 54A and 54B may be made of natural or synthetic rubber or other suitable elastomeric material, and are attached to the drum, preferably using bolts 56A and 56B respectively, and to the frame of the machine, preferably using bolts 58A and 58B respectively.

As described herein, the vibratory assembly of the invention operates to apply a series of forces to the milling drum that will enhance its cutting or milling performance. The arrangement of the components of the vibratory assembly and the isolation means in the preferred embodiments of the invention will serve to direct these vibratory forces towards the pavement surface and substantially perpendicular to the direction of travel. It has been found that when such vibratory forces are isolated to the milling assembly and so directed, the mass of the vibratory assembly and the forces created thereby may be utilized for application of greater cutting forces through the milling drum than had previously been thought possible.

Although this description contains many specifics, these should not be construed as limiting the scope of the invention but as merely providing illustrations of some of the presently preferred embodiments thereof, as well as the best mode contemplated by the inventor of carrying out the invention. The invention, as described herein, is susceptible to various modifications and adaptations, and the same are intended to be comprehended within the meaning and range of equivalents of the appended claims.

What is claimed is:

1. A portable milling machine, comprising:

(A) a frame;

(B) means for advancing the machine across a surface to be milled;

(C) a milling assembly mounted on the frame of the machine for cutting a width of material from the surface in the path of the machine, said assembly including:

(i) a generally cylindrical milling drum which is mounted for rotation about its axis, which drum is provided with a plurality of cutting teeth;

(ii) a vibratory assembly which is mounted so as to impart vibration to the milling drum, said vibratory assembly comprising:

(a) an elongate shaft;

(b) means for rotating the shaft; and (c) an eccentric weight that is mounted on the shaft, said weight having a non-symmetrical distribution of mass about the shaft so that vibration will be created upon rotation thereof;

(iii) means for isolating the vibratory assembly so as to limit the transmission of vibration created thereby to the frame of the machine.

2. The milling machine of claim 1, wherein the milling drum is mounted in an enclosure to which is attached the vibratory assembly.

3. The milling machine of claim 1, wherein at least one elastomeric pad is positioned between the vibratory assembly and the frame of the machine so as to limit the transmission of vibration created by the vibratory assembly to the frame.

4. The milling machine of claim 1, wherein the shaft is supported by and journaled in at least one bearing assembly.

5. The milling machine of claim 1, wherein the vibratory assembly includes a plurality of eccentric weights that are mounted on the shaft in such fashion that the plurality of weights have a non-symmetrical distribution of mass about the shaft so that vibration will be created upon rotation thereof.

6. The milling machine of claim 1, which includes a hydraulic motor for rotating the shaft.

7. The milling machine of claim 1, wherein the vibratory assembly is located within the milling drum.

8. The milling machine of claim 7, wherein the shaft is aligned with the axis of the milling drum.

9. A self-propelled milling machine, for milling a surface of a roadway along a direction of travel, said machine comprising:

(A) a frame;

(B) drive means mounted to the frame and adapted for advancing the machine across the surface of the roadway;

(C) a milling assembly mounted on the frame for cutting a width of material from the surface in the path of the machine, said assembly including:

(i) a generally cylindrical milling drum which is provided with a plurality of cutting teeth;

(ii) a drum enclosure in which the drum is mounted for rotation about its axis;

(iii) means for rotating the milling drum so as to rotate the cutting teeth into the surface of the roadway;

(iv) a vibratory assembly which is mounted so as to impart vibration to the milling drum, said vibratory assembly comprising:

(a) an elongate shaft that is supported by and journaled in at least one bearing assembly;

(b) a motor that is adapted for rotating the shaft; and (c) an eccentric weight that is mounted on the shaft, said weight having a non-symmetrical distribution of mass about the shaft so that vibration will be created upon rotation thereof;

(v) a plurality of elastomeric isolators which are disposed between the vibratory assembly and the frame of the machine so as to limit the transmission of vibration from the vibratory assembly to the frame of the machine;

(vi) means for removing cuttings obtained from rotation of the cutting teeth into the surface of the roadway, and for conveying said cuttings away from the milling drum.

10. The milling machine of claim 9, wherein the vibratory assembly includes a plurality of eccentric weights that are mounted on the shaft in such fashion that the plurality of weights have a non-symmetrical distribution of mass about the shaft so that vibration will be created upon rotation thereof.

11. The milling machine of claim 9, wherein the vibratory assembly is located within the milling drum.

12. The milling machine of claim 11, wherein the shaft is aligned with the axis of the milling drum.

13. A method for milling a surface of a roadway along a direction of travel, comprising:

(a) providing a milling drum that is mounted on a frame, which drum is provided with a plurality of cutting teeth and is adapted for rotational motion so as to rotate the cutting teeth into the surface of the roadway;

(b) providing means for moving the frame along the direction of travel;

(c) providing means for imparting rotational motion to the drum;

(d) moving the frame along the direction of travel;

(e) rotating the milling drum;

(f) imparting vibration to the milling drum;

(g) isolating the milling drum from the frame so as to limit the transmission of vibration from the milling drum to the frame.

14. The method of claim 13, wherein means are provided for removing cuttings obtained from rotation of the cutting teeth into the surface of the roadway, and for conveying said cuttings away from the milling drum.

15. The method of claim 13, wherein vibration is imparted to the milling assembly by the application of vibratory forces which are directed substantially perpendicular to the direction of travel.

* * * * *